United States Patent [19]

Gaudelli et al.

[11] Patent Number: 4,660,344

[45] Date of Patent: Apr. 28, 1987

[54] APPARATUS AND PROCEDURE FOR FORMING PRE-SHAPED INTERLOCKING CEMENT SLABS

[76] Inventors: Edmond N. Gaudelli, 2438 Hayson Ave., Pittsburgh, Pa. 15220; Edward E. Shepler, 1733 Potomac Ave., Dormont, Pa. 15216

[21] Appl. No.: 548,149

[22] Filed: Nov. 2, 1983

[51] Int. Cl.[4] ..... E04C 1/10

[52] U.S. Cl. ..... 52/593; 52/125.4; 52/598; 52/609; 404/7

[58] Field of Search ..... 52/102, 125.4, 414, 52/125.5, 418, 424, 430, 433, 578, 593, 596, 598, 599, 608, 609, 787; 404/7, 35, 36, 41, 98

[56] References Cited

U.S. PATENT DOCUMENTS

| | | | |
|---|---|---|---|
| 739,854 | 9/1903 | Gest | 404/7 |
| 1,529,329 | 3/1925 | Turnbo | 404/7 |
| 1,921,107 | 8/1933 | Todd | 52/593 |
| 1,991,931 | 2/1935 | Kling et al. | 429/159 |
| 2,180,842 | 11/1939 | Winding | 249/5 |
| 2,880,830 | 4/1959 | Rohe | 52/787 |
| 3,157,098 | 11/1964 | Mason | 404/7 |
| 3,174,412 | 3/1965 | Boyd et al. | 404/7 |
| 3,426,122 | 2/1969 | Gauldelli | 264/297.9 |
| 3,451,181 | 6/1969 | Neuschotz | 52/787 |
| 3,595,518 | 7/1971 | Gauldelli | 249/163 |
| 4,017,115 | 4/1977 | Holt et al. | 52/125.5 |
| 4,067,941 | 1/1978 | Gauldelli et al. | 264/69 |
| 4,069,629 | 1/1978 | Piazza | 52/125.5 |
| 4,126,979 | 11/1978 | Hancock | 52/593 |
| 4,179,151 | 12/1979 | Tye | 52/125.5 |
| 4,228,985 | 10/1980 | Gauldelli et al. | 249/93 |
| 4,437,276 | 3/1984 | Goldberg | 52/125.5 |

FOREIGN PATENT DOCUMENTS

| | | | |
|---|---|---|---|
| 488083 | 11/1952 | Canada | 404/7 |
| 599953 | 6/1960 | Canada | 52/125.5 |
| 2638905 | 3/1977 | Fed. Rep. of Germany | 404/41 |
| 2723989 | 12/1978 | Fed. Rep. of Germany | 52/125.4 |
| 2741674 | 3/1979 | Fed. Rep. of Germany | 52/125.4 |
| 344438 | 3/1960 | Switzerland | 404/7 |

*Primary Examiner*—John E. Murtagh
*Assistant Examiner*—Andrew Joseph Rudy
*Attorney, Agent, or Firm*—Parmelee, Miller, Welsh & Kratz

[57] ABSTRACT

The invention pertains to a cementitious slab and to apparatus and procedure for making it in such a manner that it may be used in an interconnected relation for providing a longitudinally extending side edging along a street or roadway. The slab product is made in a frame assembly that is positioned for turnover movement on a pair of stands. The frame assembly in its upper or mold space defining positioning has an integral enclosing side wall frame and a bottom wall, with one pair of side walls of the frame spaced from ends of the bottom wall and adapted to removably receive a pair of opposed end wall forming members for completing the mold cavity and providing the cementitious slab with tongue and groove portions. After the concrete or cement has been poured into the mold cavity, the opposed end wall members are removed and a pair of cross-ending support members are secured across a pair of the side walls to support the slab when it is turned-over or rotated 180° to a position in which its former top side faces the ground. The pair of cross-extending support members are than removed and the assembly tapped to drop the slab a short distance onto a suitable receiving means, such as forks of a fork lift truck. The bottom plate forms a smooth-finished upper face of the slab and is employed to position a pair of lift lugs that are internally threaded and extend into the mold cavity for embedment in the slab, with the threaded end exposed to provide means for facilitating lifting and transporting of the slab.

5 Claims, 11 Drawing Figures

APPARATUS AND PROCEDURE FOR FORMING PRE-SHAPED INTERLOCKING CEMENT SLABS

This invention pertains to a mold frame assembly for enabling and facilitating the forming of cement slabs such as may be used in combination to provide side edging, a border or berm along a street or road, to thus eliminate the need for forming a continuous length of such edging in place along the roadway.

A phase of the invention relates to cement or concrete slabs and to shop procedure for forming them in suitable individual shapes for handling and mounting them in a desired aligned interfitting relation along a street or road.

Attention is called to our U.S. Pat. Nos. 3,426,122 3,595,518 and 4,067,941 which deal with forming cementitious wall members by utilization of removable plywood separators and swinging walls in such a manner as to produce a plurality of pieces in one casting operation. U.S. Pat. No. 4,228,985 is representative of a plural mold assembly for forming members, such as building beams, columns, upright parking lot spacers, etc. This latter patent also show an assembly which enables a plurality of concrete members to be simultaneously formed and then removed from the molding structure after the structure has been turned-over.

SUMMARY OF THE INVENTION

Heretofore, it has been customary to form side edging along the berm or border of a road or street as a substantially continuous length by use of a temporary removable form structure, and direct pouring of the concrete in place therein. This has a number of disadvantages, including its cost of installation, its inflexibility in usage, etc. It entails several different types of work crews or groups, such as carpenters for building temporary forms in place along the roadway, another group for pouring the concrete into the forms, subject to suitable weather conditions, and another group for thereafter removing the forms, etc. The resulting berm way is a continuous length portion which then presents a problem when a business or a garage is later located along the roadway to thus require a suitable curb removed opening for a driveway thereto, when an additional utility line is to be buried, or when an existing utility line is to be maintained or replaced. Also, a continuous length portion tends to crack therealong due to unevenness of underground support, weather conditions, etc.

It has thus been an object of the invention to meet the above problem by devising apparatus and procedure for forming individual concrete slabs which may be suitably con toured or formed in the shop in a permanent mold frame to provide a driveway or a curb type as desired, and which can be easily individually mounted and removed from its roadway side-positioning.

Another object has been to devise a form of slab that will be interfitting with adjacent slabs for mounting as one of a plurality along a street or roadway, and that facilitate repair or maintenance work without the need for using a jack hammer.

Another object has been to provide apparatus and procedure for forming concrete slabs that will enable them to be produced relatively inexpensively and thereafter easily stored, transported, handled, mounted in place and removed.

A further object has been to sectionalize the provision of a berm way along a road or street whose sections may be handled not only by a fork lift truck, but also by an overhead hoist for lifting them onto and off a truck and into a mounted position.

A further object of the invention has been to greatly simplify and lessen the expense of providing a concrete berm way or side edging along a road or a street and to provide a flexible type of construction that makes use of sectionalized slab members.

These and other objects of the invention will appear to those skilled in the art from the illustrated embodiment and the claims.

Figure 11:
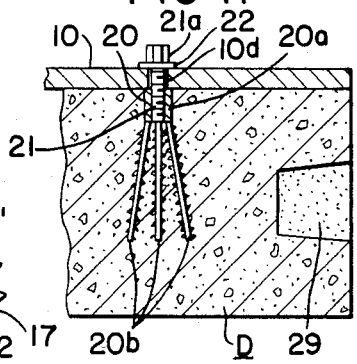

And, FIG. 11 is a greatly enlarged fragmental section in elevation illustrating how lug-like, Christmas-tree-shaped lift elements are supported and positioned during the formation of a slab in accordance with the invention.

DETAILED DESCRIPTION

Figure 1:
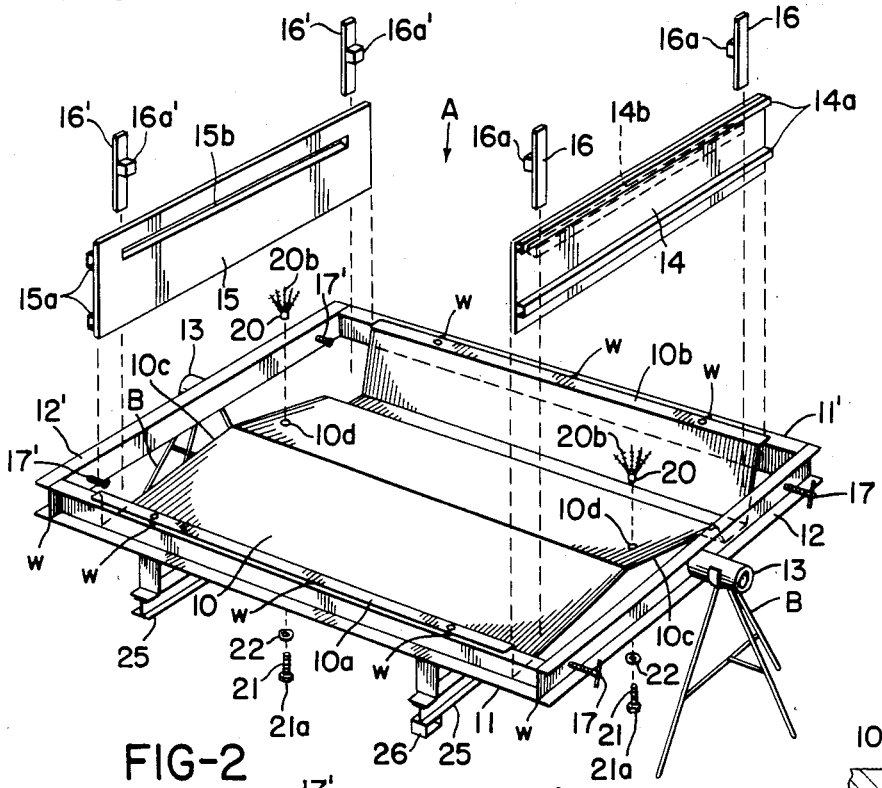
FIG. 1 is an exploded isometric view in elevation showing principal parts of a mold frame construction of the invention for forming concrete roadway slabs.

Referring particularly to FIG. 1 of the drawings, an exploded showing of a mold frame assembly A or structure of the invention is represented with the frame being in its upwardly open, cement-material-receiving position. The mold frame assembly A has a pair of opposite trunnions, pivot members or stud shafts 13 which are located at balanced, central locations at opposite ends of a first pair of opposed, channel-shaped side members 12, 12'. The trunnions 13 are adapted to rest on a pair of pivot supports, such as tripods B, that have upwardly-open collars to permit the frame structure A to be raised out of and lowered into position with respect thereto. In the structure, w has been employed to indicate weld metal used in securing various parts in an integral or unitary relation with respect to each other.

The frame A has an integral structure defined by a contoured bottom wall or base, plate member 10 having a finished inner surface whose opposite ends 10*c* and 10*c'* are exposed in a spaced apart relation with the first pair of opposed side wall members 12 and 12'. As shown, the spacing of the ends 10*c* and 10*c'* enables the vertical insertion and removal, and horizontal inward and outward movement of a pair of opposed end support members 14, 15. The members 14 and 15 are contoured and constructed to be held in tight wedging engagement against the opposite ends 10*c* and 10*c'* of the bottom wall member 10 by wedging spacer bars 16.

It will be noted that both the end support members 14 and 15 have a pair of longitudinal, horizontally-extending, projecting channels 14*a* and 15*a* secured, as by weld metal w, to their outer sides against which the spacer bars 16, 16' are adapted to abut, with their centrally disposed wedge lugs 16*a* and 16*a'* facing outwardly towards the opposed side wall members 12 and 12'. Each member 12 and 12' has a pair of thumbscrews 17, 17' that are threadably mounted therein and adapted to engage the lugs 16 and 16*a'* to tightly wedge the removable, opposed, end wall supporting and slab-shaping members 14 and 15. The members 14 and 15 are to be mounted in a mold cavity defining relation with respect to the bottom wall 10 and its opposed side walls 10*a* and 10*b* whose bent-over or horizontal rims rest on and are secured to upper flanges of a second pair of opposed side wall members of channel shape 11 and 11'.

Figure 2:
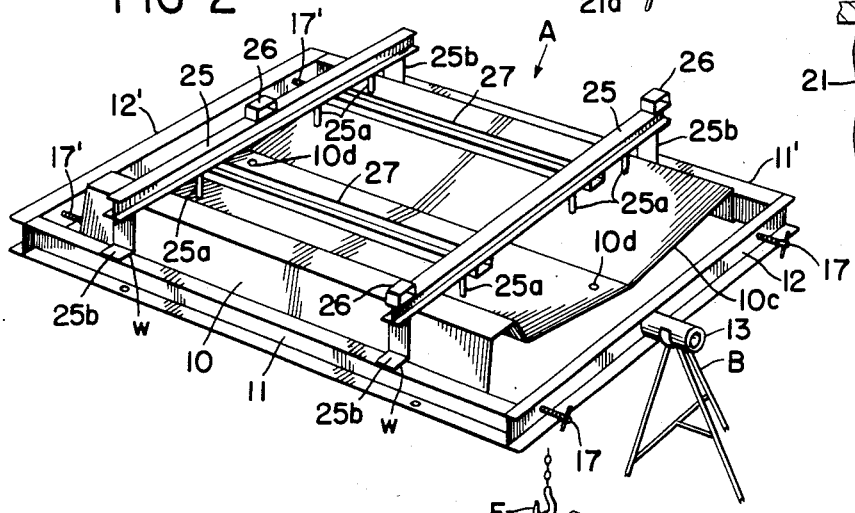
FIG. 2 is an isometric view on the same scale as FIG. 1, with the frame turned over to an upside down position to particularly illustrate an under frame support structure for its bottom or back wall plate member.

As indicated from FIGS. 1 and 2, the opposed side wall members or channels 11 and 11' are secured, as by weld metal w, at their ends to end portions of the first opposed pair of side wall members 12 and 12', to with the bottom plate member of wall 10, define an integral structure. The bottom wall 10 has, as shown in FIG. 1, a reinforcing structure consisting of a pair of longitudinal, spaced-apart and transversely extending, I-beam shaped, reinforcing members 25. The members 25 are secured, as by weld metal w, by means of feet 25*b* to bottom rim or flanges of the second pair of opposed side wall members 11 and 11'. The members 25 are also secured in a spaced relation along their lengths by feet 25*a* that extend therefrom to and are secured on the outer face of the bottom wall 10. A pair of spaced-apart, oppositely extending, reinforcing channel members 27 are shown secured to the underside portions of the I-beam shaped reinforcing members 25 to thus define a rectangular reinforcing frame. A set of triangularly oriented collars 26 are secured to opposite ends of one of the reinforcing members 25 and to a central location on the other reinforcing member 25 to enable a stabilized positioning of the frame when placed on a bottom support.

Figure 9:
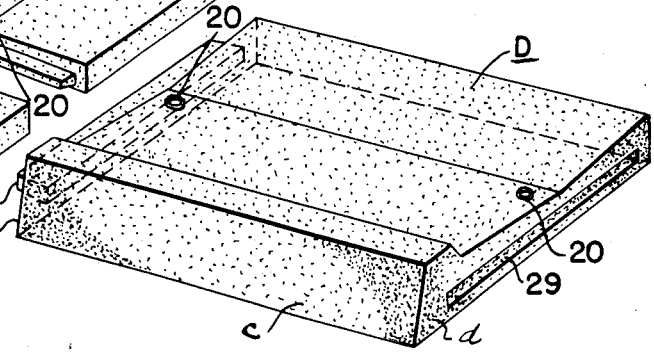
FIG. 9 is an isometric view showing a cementitious slab produced in accordance with the invention; this view is on the same scale as FIG. 8.
Figure 6:
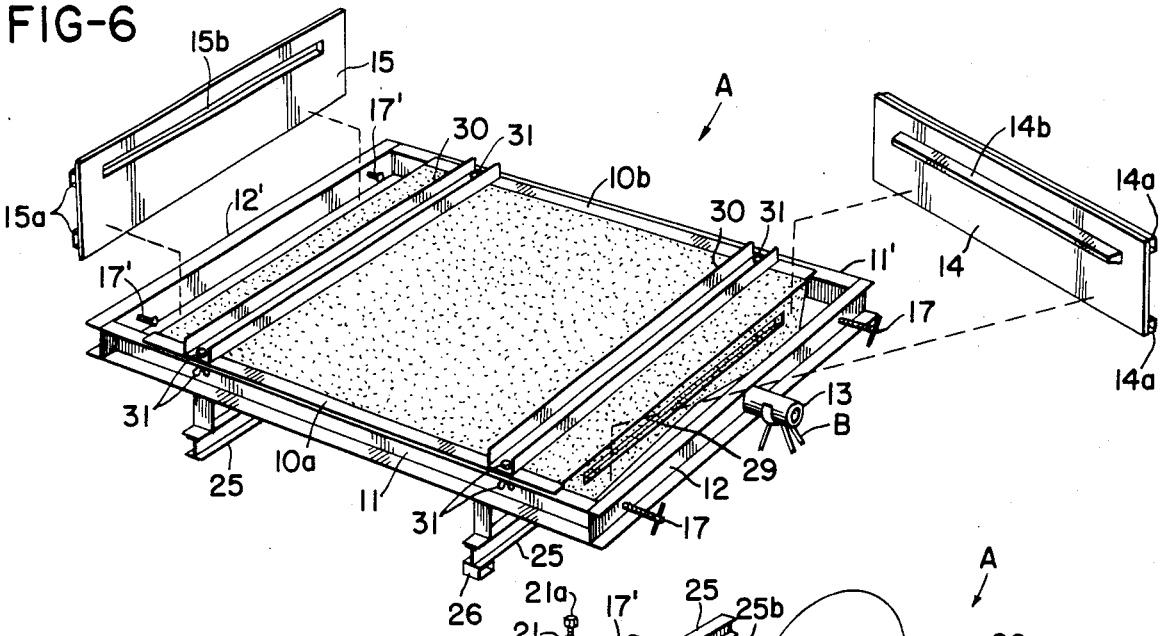
FIG. 6 is an isometric view on the scale of FIG. 5 showing the next step in disassemblying the mold frame structure in accordance with which opposed tongue and groove forming, supporting end plate members are moved horizontally and then vertically out of position with respect to opposite ends of the concrete slab, and then out of the spacing that is defined between opposite ends of the bottom wall and an opposed pair of integral side wall members of the frame structure.

Again referring to FIG. 1 and also to FIG. 6, each of the end wall members 14 and 15 has a machine-smoothed inner face, and the member 15 has a wall groove or cavity 15*b* on its inner side that is also smooth-machined. The opposed member 14 has a smooth-machined tongue portion 14*b* projecting from its inner side. The groove portion 15*b* and the tongue portion 14*b* extend longitudinally of the members 14, 15 and are employed when the members are in their mounted position shown in FIGS. 3 and 4, to serve in forming wedge-shaped interlocking tongue and groove portions 28 and 29, see FIG. 9, in the finished slab D. As will be noted from FIGS. 9 and 11, the wider width of the slot portion 29 and of the tongue portion 28 lie parallel to and along the planar end faces of the slab D that is formed.

Figure 7:
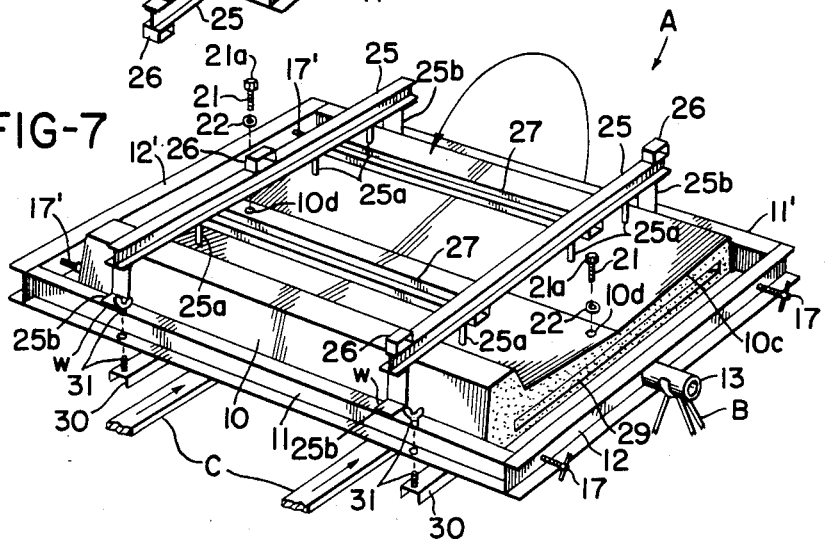
FIG. 7 is an isometric view on the same scale as FIG. 6 illustrating a further step in the procedure in accordance with which a pair of bolts are removed from the under side of the bottom wall member of the frame to release inset lift lugs that have been cast in the slab from its upper side; this view shows the frame after it has been rotated or tilted over, and after suitable receiving means from the slab, such as a pair of forks of a fork lift truck are moved into a fairly close, under, slab-receiving position with respect to the exposed under or back face of the slab; this view further illustrates the removal of a pair of slab supporting cross members which are shown secured in position in FIG. 6.

With reference to FIGS. 1, 7 and 11, it will be noted that a pair of spaced-apart, through-extending holes 10*d* are provided in the bottom wall member 10 to receive threaded stems 21 of; through-extending mounting bolt and washer assemblies 21*a*, 22. Each bolt 21*a* positions and removably carries an associated lift lug element 20. Each lift lug element 20 has an internally threaded, tubular main or trunk body part 20*a* that is open at its upper end and closed at its lower end. A group of outwardly spread, projecting, mounting legs 20*b* are secured, as by weld metal w, at their ends within the lower end of the body part 20*a* to extend in a Christmas tree-like relation downwardly and outwardly therefrom. The spread legs 20*b* are preferably provided with barbs as shown in FIG. 11.

Figure 3:
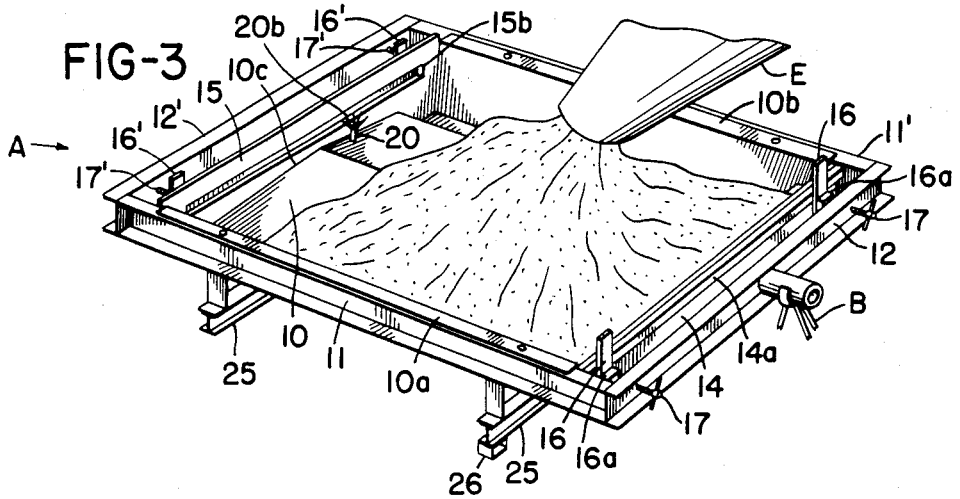
FIG. 3 is a view on the same scale as FIG. 1 showing the frame fully assembled to define a large, open, central mold space, with its cavity facing upwardly as in FIG. 1, and with cementitious material being poured therein.
Figure 4:
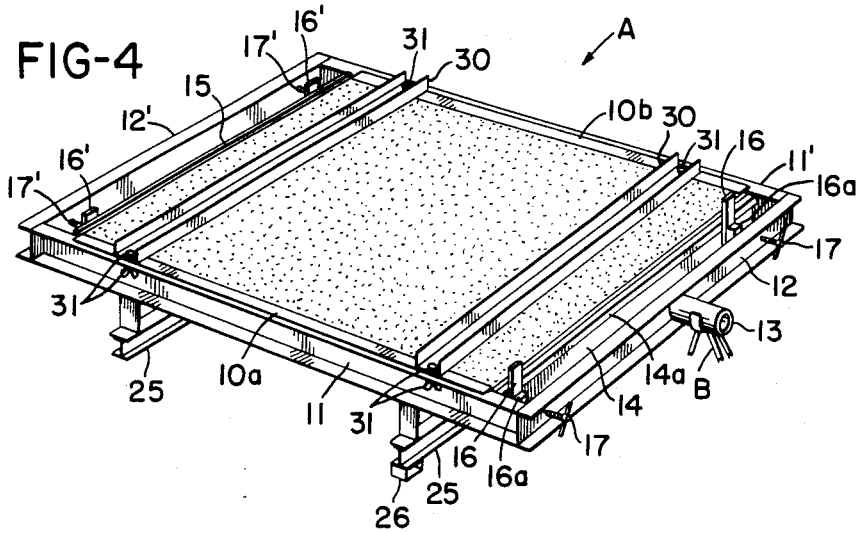
FIG. 4 is a view on the same scale and similar to FIG. 3, but showing the cementitious material fully poured to fill the mold cavity and in place to, on setting, provide a cement slab therein; it also shows a pair of removable cross-extending members for supporting the under side of the formed or cast slab when it is to be turned over, as shown in FIG. 7, for its removal from the mold frame.

As will be noted, each bolt 21*a* extends through a hole 10*d* in the bottom plate 10 and carries an associated lug 20 while, as shown in FIG. 3, cement or concrete (being referred to herein as cement) is introduced or poured into the fully assembled frame structure A. After the cementitious material has set to form the slab, as shown in FIG. 4, the lug elements 20 then become an integral part of the slab, and their open, threaded ends are positioned substantially flush with the upper finished surface of the slab D that has been shaped and contoured by engagement with the smooth under-face of the bottom wall 10.

For facilitating removal of the slab D, the inner sides of the form or cavity defining members 10, 14 and 15 may be coated with a suitable releasing material, as a light oil painted thereon. The machining of such surfaces, plus the use of a releasing liquid provides a slab D whose upper face a, opposed sides b and c and ends d will present a smooth-finished surface. The underside, as shown in FIG. 4, representing the open mouth of the mold frame structure A is of unfinished or rough appearance. This side, see FIG. 10, becomes the underside of the slab D when it is being mounted in position in an interlatching and interlocking relation as to complementary tongue and groove portions of adjacent, endwise abutting slabs. As also indicated in this figure, the lugs 20 facilitate handling the slabs D, such that suitable means represented by a hoist F carrying a pair of bolts may be mounted therein for lifting the slab, for example, at the fabricating plant onto a truck for loading it and taking it to the site, and for unloading it and placing it along the roadway in a suitable bed that has been previously prepared.

As illustrated by FIGS. 1, 2 and 3, the first step in providing a plant fabricating slab D of the invention construction is to completely assemble the molding frame A with the lug elements 20 projecting from its bottom wall inwardly of the mold cavity. FIG. 3 shows a pouring spout of E which may lead to a cement mixing machine or some other source of concrete or cementitious material. The pouring operation is continued until the cement reaches a level which, as shown in FIG. 4, substantially corresponds to a plane represented by what may be termed the flanges of the members 11 and 11' which in FIG. 4 are upward flanges of the structure.

Figure 5:
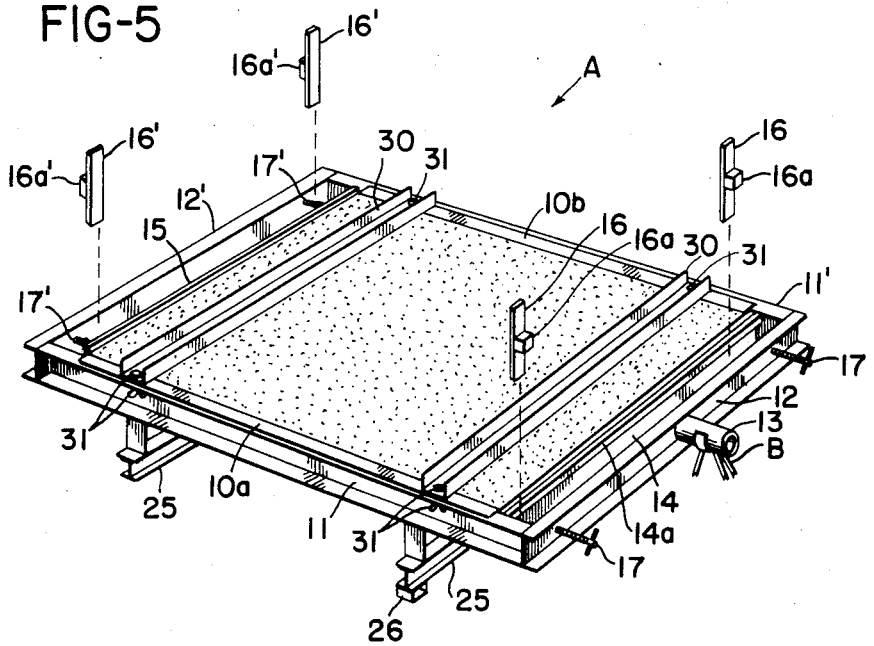
FIG. 5 is an isometric view on the scale of FIG. 4 showing a first step involved in removing opposed, contoured end support members from the frame, in accordance with which vertically inserted spacer bar elements are removed and after they have been released from tight wedging engagement within integral opposed side walls of the frame by unscrewing thumbscrews.

After the slab D has been formed, a pair of channel-shaped cross-extending support members 30 are removably secured through holes in the flange or rims of the members 11, 11' by suitable bolt and nut assemblies 31. At this time, the formed slab D may be released from its tight fitting relation within the structure after (see FIGS. 5 and 6) first unscrewing the thumbscrews 17 outwardly to release the spacer bars 16, 16' so that they may be first removed. This releases the closed end wall members 14 and 15 in such a manner that they may be first moved horizontally-endwise out of their abutting relation with the respective opposite ends of the slab D and then lifted out of position (see FIGS. 1 and 6) to fully release it.

Figure 8:
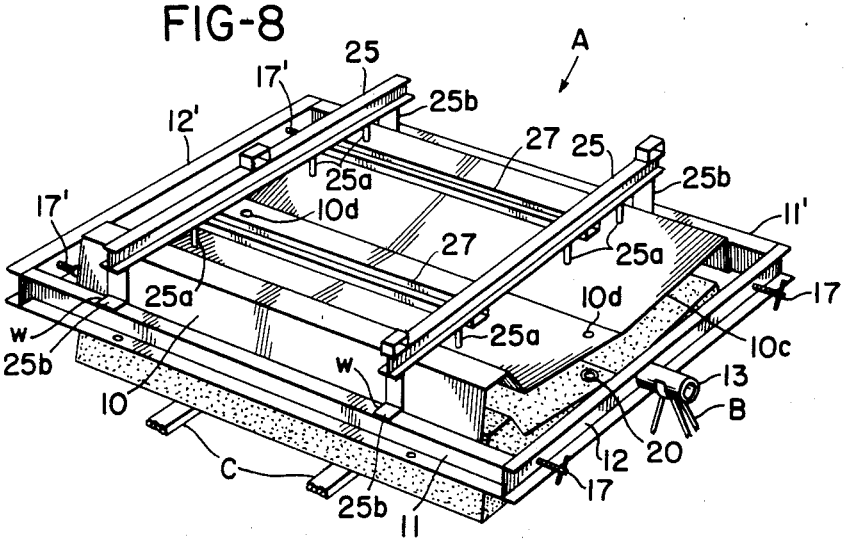
FIG. 8 is an isometric view on the same scale as the other figures illustrating releasing the formed slab from inside the mold cavity to rest on the forks of a fork lift truck for removal to a suitable storage place.

In the next step, as illustrated in FIG. 7, the assembly A may be rotated or completely turned-over on the trunnions 13, and the forks C of a fork lift truck moved into a position beneath the assembly at a sufficient distance therebeneath to permit the slab D to clear the contour of the bottom plate 10 and drop out of position onto the forks. Previous to this operation, bolts 26 of the cross-extending pair of support members 25 are removed (as shown in FIG. 7). At this time, the form or frame may be tapped resulting in the slab D dropping a short distance onto the forks C. See the resulting position of FIG. 8. The finished slab D may then be moved to a suitable plant or yard storing position. The hoist assembly F illustrated in FIG. 10 may be used at any stage for moving the slab D from place to place and, as previously pointed out, for mounting it in position at its roadside location.

Figure 10:
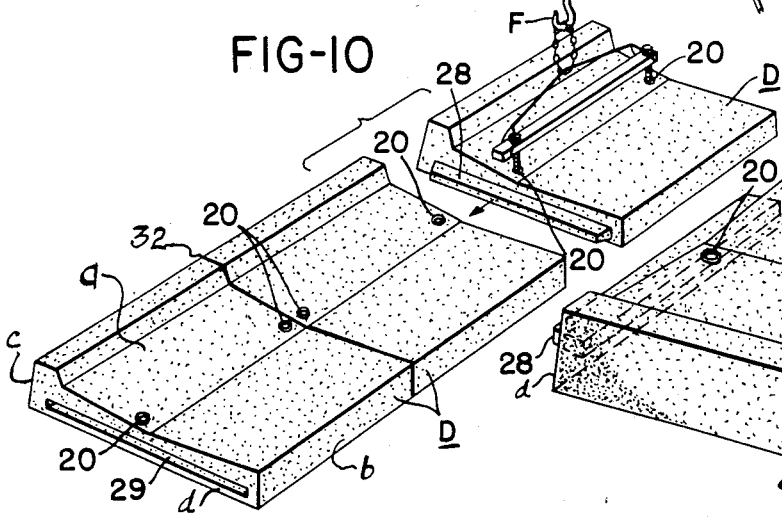
FIG. 10 is a reduced isometric view illustrating how the slabs may be mounted in place and interlatched to form a continuous line of curbing or edging along a street or roadway.

Although by way of illustration, we have illustrated a type of slab D having a slight drainage, centrally disposed, longitudinally extending concavity, as defined (see FIGS. 9 and 10) by a pair of longitudinally extending, substantially planar front and back upper face portions of the upper face a, and what may be termed, a backside wall face c, it will be recognized that any suitable shape can be produced in accordance with the invention. For example, a slab may be produced in which the curb edge c is eliminated where, for example, it is to be positioned at a driveway entry location. As shown in FIG. 10, adjacent slabs D, when aligned in an endwise fitting relation, may be provided with an expansion or sealing strip 32 between their opposed edges. This not only provides a water seal, but facilitates removal of a slab. It will be noted that the slab D has an upper face a that is defined by a pair of longitudinally extending, substantially planar front and back upper face portions. As shown, these face portions slope laterally towards each other (see FIG. 10) to define a substantially centrally positioned, longitudinally extending drainage concavity along the slab. Also, the planar back upper face portion, as shown, defines a slightly raised curb edge portion between it and the back side wall c or group of slabs when, for example, a driveway is to be installed. This manner of providing a side edging for a roadway or street not only gives a good flexibility of utilization, but enables the manufacture of the slabs within the confines of a plant without depending upon the vicissitudes of outdoor setting of concrete under various weather conditions.

The provision of wedge-shaped tongues 28 and grooves 29 not only facilitates aligned insertion and removal of one slab D with respect to another, but is important in enabling and facilitating removal of the opposed end members 14 and 15 in such a manner as to retain smooth or finished end surfaces in the cast slab D when it is to be released from the mold assembly A. The spacing between the opposed pair of side members 12 and 12' and the opposite ends of the bottom plate member 10, along with the type of mounting means **14*a*, 15*a*, 16 and 17, enables an endwise-outward clearance of the tongue and groove portions 14*b* and 15*b* of such members with respect to corresponding groove and tongue portions 29 and 28** of the cast slab D before the members are lifted out of the end spacing.

We claim:

1. An improved pour and mold cast-formed concrete slab of simplified construction that is contoured for use as one of a plurality of endwise interfitting-latching and aligned longitudinal progression of substantially planar slabs to provide a substantially sealed-off joined longitudinally extending side edging for a street or roadway to finish the side paving thereof along its berm which comprises, a non-laminated unitary rectangular-shaped slab body of cast-molded solidified cementitious material having a rough pour-finished roadway mounting under surface face and a smoothly mold-finished and contoured upper surface face, said upper surface face being defined by a pair of longitudinally extending substantially planar front and back upper face portions that slope laterally towards each other to define a substantially centrally-positioned longitudinally-extending drainage concavity along the slab, said planar back face portion defining a raised curb portion along and with said back side wall, said body having a pair of longitudinally extending depthwise-defined vertical front an back substantially parallel opposed side walls and a pair of laterally extending depthwise-defined smoothly finished vertical and substantially parallel opposed end walls, said one end wall of said pair having an outwardly projecting, smoothly finished ledge-like tongue portion horizontally therealong and spaced laterally inwardly from said upper and upper surface faces as well as longitudinally inwardly from said pair of front and back opposed side walls of said slab body, the other end wall of said pair having a smoothly finished shelf-like groove portion extending horizontally therealong that is complementary with said tongue portion and spaced laterally inwardly from said under and upper surface faces as well as longitudinally inwardly from said pair of front and back opposed side walls; said under surface face being roughly pour-formed as an upwardly exposed surface within the mold, and said upper surface face and said pair of opposite end walls being cast-formed and contoured with smoothly finished surfaces by inner walls of the mold.

2. An improved concrete slab as defined in claim 1 wherein said pair of front and back side walls are also cast-formed and contoured with smoothly finished surfaces by inner walls of the mold.

3. An improved concrete slab as defined in claim 1 wherein said tongue and groove portions are of complementary wedge shape with respect to each other.

4. An improved concrete slab as defined in claim 1 wherein, a lift element has an internally threaded tubular part extending into the slab body and provided with an open end portion that is flush with the smoothyl finished said upper surface face, said tubular part is adapted to removably receive a mounting bolt extending downwardly therefrom during the pouring and casting of said slab body and to also removably receive a lift bolt extending downwardly therefrom when said slab body as-cast is to be handled, and a group of mounting legs extend in an outwardly Christmas tree-like spread relation from an inner end portion of said tubular part within said slab body.

5. An improved concrete slab as defined in claim 4 wherein, said mounting legs have barbs extending outwardly therefrom in a spaced relation therealong, and a pair of said lift elements of the defined construction is mounted in spaced-apart relation along said upper surface face within said slab body.

* * * * *